United States Patent [19]

Miyakawa

[11] Patent Number: 4,644,116

[45] Date of Patent: Feb. 17, 1987

[54] PRESSURE SWITCH INCLUDING A SPECIAL SEAL MEMBER

[75] Inventor: Yoshitaka Miyakawa, Kawagoe, Japan

[73] Assignee: Honda Giken Kogyo Kabushiki Kaisha, Tokyo, Japan

[21] Appl. No.: 741,641

[22] Filed: Jun. 5, 1985

[30] Foreign Application Priority Data

Jun. 14, 1984 [JP] Japan ..... 59-122592

[51] Int. Cl.[4] ..... H01H 35/34

[52] U.S. Cl. ..... 200/83 R; 200/83 J; 73/723

[58] Field of Search ..... 307/118; 200/83 R, 83 P, 200/83 J, 83 S, 83 SA, 302; 73/861.44, 861.47, 717, 723; 340/626

[56] References Cited

U.S. PATENT DOCUMENTS

| | | | |
|---|---|---|---|
| 3,676,620 | 7/1972 | Modes | 200/83 S |
| 4,081,636 | 3/1978 | Rice | 200/83 J |
| 4,107,492 | 8/1978 | Moon, Jr. | 200/83 J |
| 4,194,103 | 3/1980 | Smith | 200/83 P |
| 4,220,836 | 9/1980 | Hersey | 200/83 P |
| 4,456,801 | 6/1984 | Lauritsen | 200/83 P |

*Primary Examiner*—G. P. Tolin

*Attorney, Agent, or Firm*—Armstrong, Nikaido, Marmelstein & Kubovcik

[57] ABSTRACT

A pressure switch wherein the interior of a casing is divided by a partition into a fluid chamber fed with a fluid the pressure of which is to be detected, and a working chamber in which a switch mechanism is housed. A rod extends slidably through the partition, provided at its one end with a pressure-receiving portion which is adapted to receive a fluid pressure in the fluid chamber, and projecting at the other end portion thereof into the working chamber so as to change the switching mode of the switch mechanism in accordance with displacement, which occurs due to a fluid pressure applied to the pressure-receiving portion, of the rod to the end thereof which is on the side of the switch mechanism. Springs urge the rod towards the fluid chamber. The fluid chamber is further provided therein with a first spring member the force of which constitutes a part of the desired force of the rod-urging spring. The working chamber is further provided therein with a second spring member the force of which constitutes the remaining part of the desired force of the rod-urging springs. The force of either of the first and second spring members are regulatable. The fluid chamber is further provided therein with a flexible pressure-receiving seal member which is fitted around the pressure-receiving portion of the rod, and which is engaged resiliently at its circumferential portion with the inner surface of the fluid chamber so as to function as a seal.

14 Claims, 4 Drawing Figures

PRESSURE SWITCH INCLUDING A SPECIAL SEAL MEMBER

BACKGROUND OF THE INVENTION

1. Field of the Invention

This invention relates to a pressure switch, and more particularly to a pressure switch wherein the interior of a casing is divided by a partition into a fluid chamber fed with a fluid the pressure of which is to be detected, and a working chamber in which a switch mechanism is housed. A rod extends slidably through the partition, provided at its one end with a pressure-receiving portion which is adapted to receive a fluid pressure in the fluid chamber, and projecting at the other end portion thereof into the working chamber so as to change the switching mode of the switch mechanism in accordance with the displacement, which occurs due to a fluid pressure applied to the pressure-receiving portion, of the rod to the end thereof which is on the side of the switch mechanism. Spring means urge the rod to the side of the fluid chamber.

2. Description of the Prior Art

There is a conventional pressure switch of this kind, which consists of a fluid chamber, a metal diaphragm supported at its peripheral portion on side walls of the fluid chamber, a rod fixed at its one end to the metal diaphragm, and a switching mechanism the switching mode of which is changed when a fluid pressure is applied to the diaphragm bending the diaphragm against the resilient force thereof and thereby displacing the rod axially toward the other end thereof. In such a pressure switch, a skilled hand is required to set the resilient force to a suitablè level. Therefore, it is necessary to improve the manufacturing accuracy of the diaphragm. There is also a conventional pressure switch in which a rod is urged by a coil spring. In this pressure switch, it is also troublesome to set the resilient force of the coil spring to a suitable level.

In such a pressure switch, it is necessary that the peripheral portion of the diaphragm be reliably fused to the casing for the purpose of sealing a fluid chamber and a working chamber from each other. Accordingly, special welding techniques are required. There is also a conventional pressure switch made with a view to meeting these requirements, in which a fluid pressure is applied directly to a pressure-receiving portion at one end thereof. In this pressure switch, a seal member is inserted between the rod and the partition so as to seal a fluid chamber and a working chamber from each other. Consequently, the sliding resistance of the rod increases to cause hysteresis to occur. This hampers the manufacturing of a high-pressure small-sized pressure switch having excellent performance.

SUMMARY OF THE INVENTION

An object of the present invention is to provide a pressure switch which is capable of employing rod-urging springs of a comparatively low accuracy, and regulating the resilient force of the springs easily.

Another object of the present invention is to provide a pressure switch which is capable of reducing the sliding resistance and thereby minimizing the hysteresis, being made high-pressure-resistant and to small dimensions, and omitting the requirement for a skilled hand for the manufacture thereof.

In order to achieve the above objects, according to one aspect of the present invention, there is proposed a pressure switch wherein the interior of a casing is divided by a partition into a fluid chamber fed with a fluid, the pressure of which is to be detected, and a working chamber in which a switch mechanism is housed. A rod extends slidably through the partition, provided at its one end with a pressure-receiving portion which is adapted to receive a fluid pressure in the fluid chamber, and projecting at the other end portion thereof into the working chamber so as to change the switching mode of the switch mechanism in accordance with displacement of the rod. Displacement occurs due to a fluid pressure applied to the pressure-receiving portion of the rod to the end thereof which is on the side of the switch mechanism. A spring means urges the rod towards the fluid chamber. This aspect of the invention is characterized in that the fluid chamber is further provided therein with a first spring member, the force of which constitutes a part of the force of the rod-urging spring means. The working chamber is further provided therein with a second spring member the force of which constitutes the remaining part of the force of the rod-urging spring means. The force of either of the first and second spring members is regulatable.

According to the second aspect of the present invention, there is proposed a pressure switch wherein the interior of a casing is divided by a partition into a fluid chamber fed with a fluid the pressure of which is to be detected, and a working chamber in which switch mechanism is housed. A rod extends slidably through the partition, provided at its one end with a pressure-receiving portion which is adapted to receive a fluid pressure in the fluid chamber, and projecting at the other end portion thereof into the working chamber so as to change the switching mode of the switch mechanism in accordance with displacement of the rod. Displacement occurs due to a fluid pressure applied to the pressure-receiving portion, of the rod to the end thereof which is on the side of the switch mechanism. A spring means urges the rod toward the fluid chamber. This aspect of the invention is characterized in that the fluid chamber is further provided therein with a flexible pressure-receiving seal member which is fitted around the pressure-receiving portion of the rod, and which is engaged resiliently at its circumferential portion with the inner surface of the casing to form a seal.

As stated above, the fluid chamber houses therein a first spring member, the force of which constitutes a part of the force of a rod-urging spring means, and the working chamber houses a second spring member, the force of which constitutes the remaining part of the force of the rod-urging spring means. The force of either the first spring member or the second spring member is set regulatable. Accordingly, even if the accuracy of the first and second springs is low, the desired resilient force can be regulated very easily. Moreover, the total resilient force of the spring members can be finely regulated by a comparatively large quantity of regulation.

Flexible pressure-receiving seal member fitted around the pressure-receiving portion of the rod and engaged resiliently at its circumferential portion with the inner surface of the casing to form a seal is housed in the fluid chamber. Accordingly, the fluid chamber can be sealed by merely inserting the pressure-receiving seal member in the fluid chamber, and no special welding techniques are required. Moreover, since the pressure-receiving seal member is merely bent by a fluid pressure, and not moved, the sliding resistance of the rod decreases, and the hysteresis decreases as well accordingly. This enables the manufacturing of a high-pressure-resisting miniature pressure switch.

If a cylindrical seal portion is formed integrally with the circumferential portion of the pressure-receiving seal member to bend a free end of this seal portion in the radial direction and engage the same with the inner surface of the fluid chamber, the seal portion contacts the inner circumferential surface of the fluid chamber and the inner surface of an end wall thereof resiliently to function as a seal. This enables the construction of the pressure switch to be simplified, and the number of the parts thereof to be reduced.

The above and other objects as well as advantageous features of the invention will become apparent from the following description of the preferred embodiment taken in conjunction with the accompanying drawings.

DESCRIPTION OF THE PREFERRED EMBODIMENTS

Figure 1:
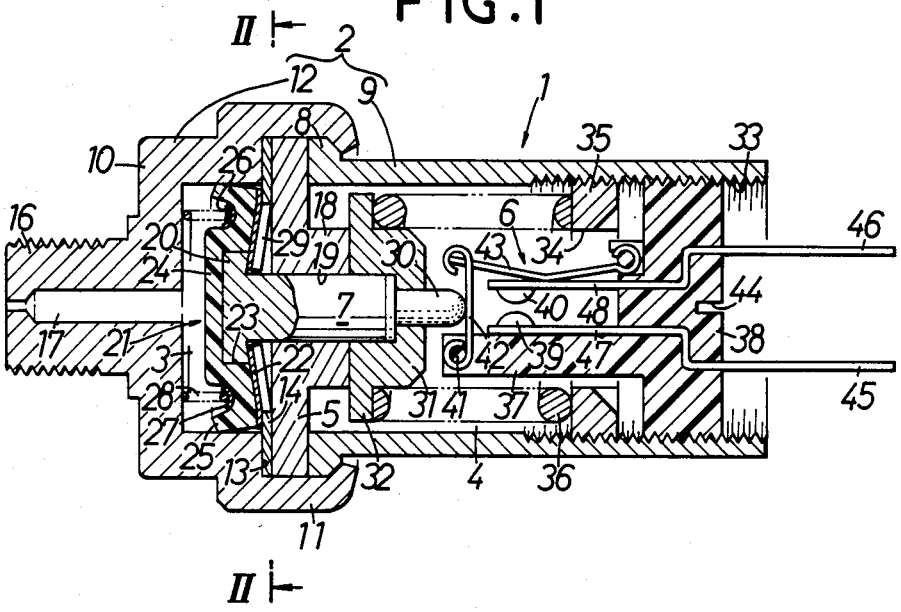
FIG. 1 is a general longitudinal section of a first embodiment of the pressure switch according to the present invention.

The embodiments of the present invention will now be described with reference to the drawings. First, referring to FIG. 1 which illustrates a first embodiment of the present invention, the interior of a casing 2 of the pressure switch 1 is divided into a fluid chamber 3 and a working chamber 4 by a partition 5. A fluid, the pressure of which is to be detected is introduced into the fluid chamber 3, and a switch mechanism 6 is housed in the working chamber 4. When fluid pressure in the fluid chamber 3 exceeds a predetermined level, the switching mode of the switch mechanism 6 is changed, for example, the switch mechanism 6 is turned on in this embodiment, by a rod 7. Accordingly, the fluid pressure exceeding a predetermined level can be detected.

The casing 2 consists of a first cylindrical member 9 provided with an outer flange 8 at one end thereof, and a bottomed second cylindrical member 12 having an end wall 10 at one end thereof and a larger-diameter cylindrical portion 11 at the other end thereof, the cylindrical member 9 being combined unitarily with the bottomed cylindrical member 12. The first cylindrical member 9 and the second cylindrical member 12 are combined together by caulking the free end of the larger-diameter cylindrical portion of the latter to the outer flange 8 of the former. A partition 5 and a first spring member 14 are provided between the end surface of the outer flange 8 and a stepped portion 13 which is provided in the second cylindrical member 12 so as to face the open end thereof. When the first cylindrical member 9 and the second cylindrical member 12 have been combined, the partition 5 and the first spring member 14 are held firmly therebetween.

In the interior of the casing 2, the fluid chamber 3 is defined by the partition 5 and the second cylindrical member 12. A base member 38 which constitutes an element of the switch mechanism 6 is screwed to the non-combined end of the first cylindrical member 9. The working chamber 4 is defined by the base member 38, first cylindrical member 9 and partition 5. A connecting tube 16 is formed integrally with the end wall 10 of the second cylindrical member 12 so as to project outward, and a fluid passage 17 which is communicated with the fluid chamber 3 is formed in the connecting tube 16 and end wall 10.

The partition 5 is provided at its central portion with a cylindrical projection 18 which is formed integrally therewith and which extends toward the working chamber 4. The projection 18 is provided therein with a slide bore 19 which opens to both the fluid chamber 3 and working chamber 4. The rod 7 is fitted slidably in this slide bore 19, and an enlarged disc type pressure-receiving portion 20 is provided at the end portion of the rod 7 which projects into the fluid chamber 3.

In the fluid chamber 3, a pressure-receiving seal member 21 made of a flexible material, such as a synthetic resin is fitted around the pressure-receiving portion 20 of the rod 7. The first spring member 14 is engaged at its inner edge with the pressure-receiving portion 20. A protective plate 22 made of a flexible material is inserted between the first spring member 14 and pressure-receiving seal member 21.

The pressure-receiving seal member 21 comprises a dish-shaped portion 24 having a recess 23 in which the pressure-receiving portion 20 is fitted, and a cylindrical seal portion 25 the diameter of which increases from the circumference of the dish-shaped portion 24 toward the end wall 10 of the bottomed cylindrical member 12. The seal portion 25 is engaged at its circumferential edge with the inner surface of the fluid chamber 3. A ring type spring seat 27 is fitted in an annular groove 26 formed by the dish-shaped portion 24 and seal portion 25 so as to face the end wall 10. A coil spring 28 is provided between the spring seat 27 and end wall 10. The pressure-receiving seal member 21 is engaged with the first spring member 14 via the protective plate 22. The spring seat 27 is formed arcuately in cross-section in such a manner that the spring seat 27 projects toward the pressure-receiving seal member 21, and the resilient force of the coil spring 28 also works in the direction in which the circumferential edge of the seal portion 25 engages with the inner surface of the fluid chamber 3.

Figure 2:
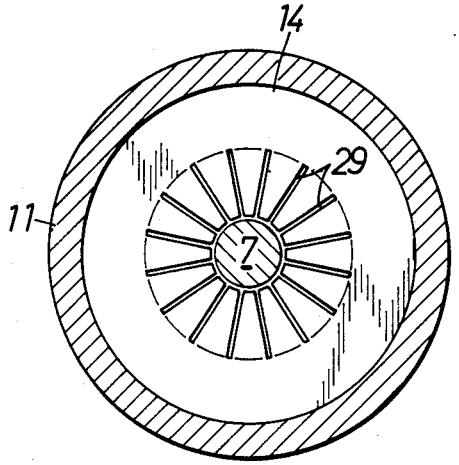
FIG. 2 is a sectional view taken along the line II—II in FIG. 1.

Referring to FIG. 2, the first spring member 14 comprises a plate spring formed by making a plurality of radial cuts 29 in an inner circumferential portion of a doughnut-shaped metal disc defining trapezoids (which are bent axially) as shown in this figure, or by arranging a plurality of fan-shaped plates, each of which has such cuts 29, to a circular shape. In order to prevent the pressure-receiving seal member 21 from eating into and projecting from the cuts 29, the protective plate 22 is inserted between the first spring member 14 and pressure-receiving seal member 21. The first spring member 14 is designed so that the resilient force thereof constitutes the greater part of the desired resilient force for urging the rod 7. The rod 7 is urged resiliently by the first spring member in the direction in which the rod 7 moves toward one end thereof, i.e., projects into the fluid chamber 3.

In the working chamber 4, a push rod 30 is engaged with the other end of the rod 7. The push rod 30 is held on this end of the rod 7 by fitting a retainer member 31 therearound. The push rod 30 projects from the retainer member 31 into the working chamber 4. An annular spring seat portion 32 projects from the outer circumferential surface of the retainer member 31. The first cylindrical member 9 is provided in an inner surface of the free end portion thereof with a female thread 33, with which a circular regulating member 35 having a through bore 34 in the central portion thereof is engaged so that the regulating member 35 can be axially moved forward and backward. A second coil spring member 36 is provided between the spring seat portion 32 and regulating member 35, and adapted to urge the retainer member 31, i.e. the rod 7 and push rod 30 toward the fluid chamber 3. The resilient force of the second spring member 36 is set so that it constitutes the part of the desired resilient force for urging the rod 7 which corresponds to the difference between this desired rod-urging force and the resilient force of the first spring member 14. The resilient force of the second spring member 36 can be regulated by moving the regulating member 35 forward or backward.

The switch mechanism 6 consists of a base member 38 engaged with the female thread 33 and composed of a disc type non-conductive material which has a support portion 37 extending toward the retainer member 31, a fixed contact 39 held on the support portion 37, a movable contact 40 provided in opposition to the fixed contact 39, a lever 42 which is supported pivotably at its free end on a pin 41 extending at right angles to the direction in which the rod 7 is moved, and which is in contact with the push rod 30, and a plate spring 43 disposed on the opposite side of the fixed contact 39 with respect to the movable contact 40 and adapted to urge the movable contact 40 toward the fixed contact 39 in accordance with a pivotal movement of the lever 42.

The base member 38 is provided in its outer end surface with a recess 44 with which a driver is to be engaged. A pair of conductive plates 45, 46 of conductors are buried in the base member 38 with their respective outer end portions drawn to the outside. One conductive plate 45 is extended as a conductive portion 47 on the support portion 37, and the fixed contact 39 is provided on the inner end of the conductive portion 47. The other conductive plate 46 is extended as a conductive portion 48 in opposition to the conductive portion 47. The movable contact 40 is provided on the inner end of the conductive portion 48. The conductive portion 48 can be turned resiliently about the portion, which serves as a fulcrum thereof which is buried in the base member 38. The plate spring 43 is connected at its one end to the base member 38 and contacts the conductive portion 48, and the other end of the plate spring 43 is engaged with the other end of the lever 42. Accordingly, a clockwise pivotal movement in FIG. 1 of the lever 42 is amplified by the plate spring 43 and transmitted to the conductive portion 48, and the movable contact 40 is displaced toward the fixed contact 39.

Figure 3:
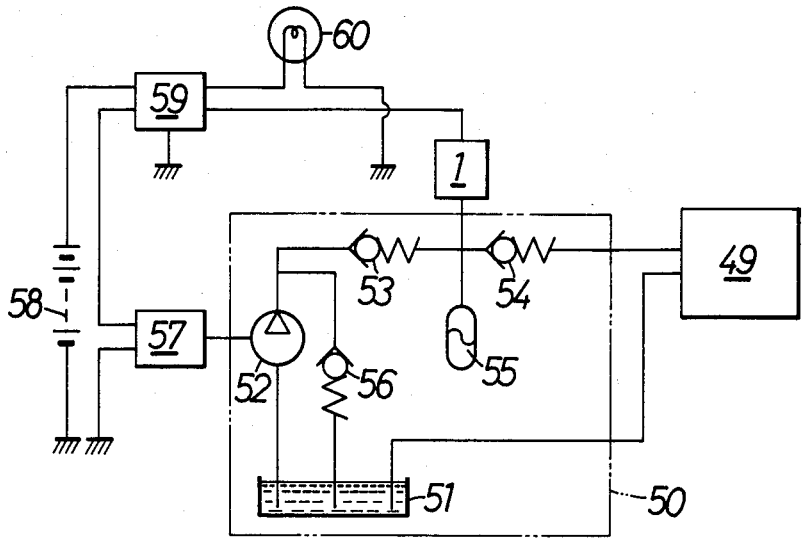
FIG. 3 is a diagram of a hydraulic circuit using a pressure switch.

Such pressure switch 1 is used in, for example, a hydraulic circuit shown in FIG. 3. Referring to the drawing, a hydraulic pressure supply source 50 for use in supplying a hydraulic pressure to a hydraulic device 49 comprises an oil tank 51, a hydraulic pump 52, one-way valves 53, 54, an accumulator 55, and a relief valve 56. A motor 57 for driving the hydraulic pump 52 is controlled by a control circuit 59 connected to a power source 58. In order to control the operation of the motor 57 in such a hydraulic circuit when a hydraulic pressure supplied from the hydraulic pressure supply source 50 becomes not lower than a predetermined level, the pressure switch is connected to the portion of an oil passage which is between the one-way valves 53, 54, so as to input a signal into the control circuit 59 when the hydraulic pressure supplied has become not lower than a predetermined level. When a signal is inputted into the control circuit 59, an alarm lamp 60 is lit by the same circuit, and the operation of the motor 57 is controlled thereby.

The operation of this embodiment will now be described. When fluid pressure introduced into the fluid chamber 3 has exceeded a predetermined level based on the resilient force of the first and second spring members 14, 36, the pressure-receiving seal member 21 is bent at its central portion toward the partition 5 to cause the rod 7 to be displaced to the working chamber 4. Consequently, the lever 42 is pressed by the push rod 30 and turned, so that the movable contact 40 engages with the fixed contact 39 to cause the switch mechanism to be turned on. As a result, an electric current flows between the conductive plates 45, 46, and a signal indicating that the fluid pressure has exceeded a predetermined level can be obtained from the conductive plates 45, 46. When the fluid pressure has decreased to a level lower than the predetermined level, the rod 7 is displaced to the fluid chamber 3 owing to the resilient force of the first and second spring members 14, 36. As a result, the movable contact 40 disengages from the fixed contact 39 to cut off the electric current, so that the pressure-receiving member 21 is restored to its original condition.

During the above-described operation, the pressure-receiving seal member 21 is bent at its central portion alone, and not moved. Therefore, the free edge of the seal portion 25 contacts the inner surface of the casing 3 in the same position, and merely functions as a seal. Hence, the sliding resistance does not vary. Accordingly, hysteresis, which is caused by variations in the sliding resistance, does not occur. This enables the detection of a high fluid pressure and the miniaturization of the pressure switch.

The resilient force of the second spring member 36 can be regulated by moving the regulating member 35 forward and backward. A very small part of the total desired resilient force to be applied to the rod 7 is constituted by the resilient force of the second spring member 36. Accordingly, the whole actual resilient force applied to the rod 7 can be finely regulated by a comparatively large stroke of the regulating member 35. The first spring member 14 is supported at its outer side portion on the casing 2, i.e., the first spring member 14 has a simple cantilever structure. Therefore, strain which occurs in a disc spring and a diaphragm spring can be prevented from occurring in the first spring member 14.

Figure 4:
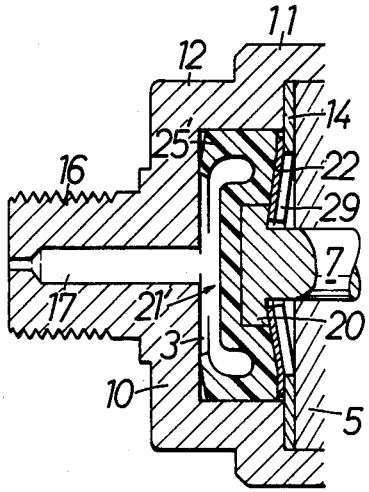
FIG. 4 is a longitudinal section of a principal portion of a second embodiment of the present invention.

FIG. 4 shows a second embodiment of the present invention, in which a pressure-receiving seal member 21' is housed in a fluid chamber 3. This pressure-receiving seal member 21' is provided at its circumferential portion with a cylindrical seal section 25' which is formed integrally therewith. The free end portion of this seal section 25' is bent inward in the radial direction so as to be engaged with the inner surface of an end wall 10. The construction of the remaining parts of this embodiment is identical with that of the corresponding parts of the first embodiment.

In the second embodiment, the cylindrical seal section 25', which is formed integrally with the circumferential portion of the pressure-receiving seal member 21', is engaged resiliently with the inner circumferential surface of the fluid chamber 3 and with the inner surface of the end wall 10 to function as a seal and thereby render the coiled spring 28 and spring seat 27, which are used in the first embodiment, unnecessary.

It is readily apparent that the above-described improvement in a pressure switch meets all of the objects mentioned above and also has the advantage of wide commercial utility. It should be understood that the specification form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A pressure operated switch with a seal member comprising a casing having an interior, a partition dividing the interior into a fluid chamber fed with a fluid, the pressure of which is to be detected, and a working chamber, a switch mechanism housed in the working chamber, a rod with opposite ends thereof extending through the partition in an axially slidable manner and having one of the ends formed with a pressure-receiving portion located in the fluid chamber and the other end projecting into the working chamber and engaging a portion of the switch mechanism to change the switching mode of the switch mechanism in accordance with the axial displacement of the rod, a flexible pressure-receiving seal member inserted within the fluid chamber with the outer circumferential portion thereby freely and non-fixedly contacting and sealing the inner cylindrical surface of the casing defining said fluid chamber, and first and second spring means urging the rod towards the fluid chamber against the fluid pressure in the fluid chamber, wherein the first spring means is an annular plate spring positioned in the fluid chamber which supports the pressure-receiving portion of the rod and contacts a free side portion of the flexible pressure-receiving seal member and the second spring means has a resilient force which is only a portion of the desired force for urging the rod.

2. A switch according to claim 1, wherein the first spring means has a constant resilient force.

3. A switch according to claim 1, wherein the first spring means is positioned between the partition and the flexible pressure-receiving seal member, and the second spring means is positioned in the working chamber.

4. A switch according to claim 3, wherein the first spring means has an inner side portion including a plurality of radial cuts therein.

5. A switch according to claim 4, wherein a protective plate of a flexible material is interposed between the pressure-receiving seal member and the first spring means.

6. A switch according to claim 4, wherein the inner side portion of the first spring means is axially bent to engage the rear surface of the pressure-receiving portion of the rod.

7. A switch according to claim 5, wherein the inner side portion of the first spring means is axially bent to be engaged with the rear surface of the pressure-receiving portion of the rod.

8. A pressure operated switch with a seal member comprising a casing having an interior, a partition dividing the interior into a fluid chamber fed with a fluid, the pressure of which is to be detected, and a working chamber, a switch mechanism housed in the working chamber, a rod with opposite ends extending through the partition in an axially slidable manner and having one of the ends formed with a pressure-receiving portion located in the fluid chamber and the other end projecting into the working chamber and engaging a portion of the switch mechanism to change the switching mode of the switch mechanism in accordance with the axial displacement of the rod, and spring means urging the rod towards the fluid chamber against the fluid pressure in the fluid chamber, wherein a flexible pressure-receiving seal member is provided in the fluid chamber and is fitted at a central portion thereof around the pressure-receiving portion of the rod, the pressure-receiving seal member being resiliently, freely and non-fixedly engaged at an outer circumferential portion thereof with an inner cylindrical surface of the casing to thereby define the fluid chamber and to form a seal between the fluid chamber and the working chamber, the flexible seal member further being supported and contacted by the spring means, the outer side portion of the seal member being wholly supported in said fluid chamber where the fluid pressure acts.

9. A switch according to claim 8, wherein the pressure-receiving seal member is provided at the outer side portion thereof with a cylindrical seal portion formed integrally therewith, and a circumferential edge of the seal portion is bent radially so as to engage with an end wall of the casing.

10. A switching according to claim 8, further including a spring for urging the side portion of the pressure-receiving seal member toward the partition and into tight contact against the inner surface of the casing thereby defining the fluid chamber.

11. A switch according to claim 8, wherein the spring means comprises a first spring member in the form of an annular plate spring which is interposed between the pressure-receiving seal member and the partition around the rod to support the seal member.

12. A switch according to claim 11, wherein the annular plate spring has an inner side portion with a plurality of radial cuts therein.

13. A switch according to claim 11, wherein a protective plate of a flexible material is interposed between the pressure-receiving seal member and the annular plate spring.

14. A switch according to claim 12, wherein the inner side portion of the annular plate spring is axially bent to be engaged with the rear surface of the pressure-receiving portion of the rod.

* * * * *